US008708006B2

(12) United States Patent
Martin

(10) Patent No.: US 8,708,006 B2
(45) Date of Patent: Apr. 29, 2014

(54) LIQUID CONTAINER REFILLING SYSTEM AND METHOD

(76) Inventor: Gary A. Martin, Commerce Township, MI (US)

( * ) Notice: Subject to any disclaimer, the term of this patent is extended or adjusted under 35 U.S.C. 154(b) by 379 days.

(21) Appl. No.: 13/221,313

(22) Filed: Aug. 30, 2011

(65) Prior Publication Data

US 2012/0048420 A1 Mar. 1, 2012

Related U.S. Application Data

(60) Provisional application No. 61/378,433, filed on Aug. 31, 2010.

(51) Int. Cl.
*B65B 39/00* (2006.01)

(52) U.S. Cl.
CPC ..... *B65B 39/001* (2013.01)
USPC ..... 141/330; 141/2; 141/21; 141/389

(58) Field of Classification Search
CPC ..... B65B 3/04; B65B 39/001; B67C 3/02; F16K 24/02
USPC ..... 141/2, 18, 21, 98, 329–330, 348, 141/387–389
See application file for complete search history.

(56) References Cited

U.S. PATENT DOCUMENTS

| | | | | |
|---|---|---|---|---|
| 1,818,122 | A * | 8/1931 | Engbrecht | 184/1.5 |
| 2,786,718 | A * | 3/1957 | Middlestadt | 239/272 |
| 3,211,191 | A * | 10/1965 | Honisch | 141/20 |
| 3,442,303 | A * | 5/1969 | Kellems | 141/18 |
| 4,154,401 | A * | 5/1979 | Thompson | 239/373 |
| 4,173,858 | A * | 11/1979 | Cassia | 53/471 |
| 4,360,130 | A | 11/1982 | Nishimura et al. | |
| 4,886,192 | A | 12/1989 | Cassia | |
| 5,439,144 | A | 8/1995 | Holzner | |
| 5,480,068 | A | 1/1996 | Frazier et al. | |
| 5,546,979 | A * | 8/1996 | Clark et al. | 137/318 |
| 5,975,152 | A * | 11/1999 | Kluge | 141/20 |
| 5,992,698 | A | 11/1999 | Copeland et al. | |
| 6,422,273 | B1 * | 7/2002 | Campbell | 141/65 |
| 6,623,257 | B2 * | 9/2003 | Taniguchi | 417/478 |
| 6,871,679 | B2 * | 3/2005 | Last | 141/329 |
| 7,654,417 | B2 | 2/2010 | Rhodenbaugh et al. | |
| 2005/0031475 | A1 * | 2/2005 | Taniguchi | 417/472 |

* cited by examiner

*Primary Examiner* — Gregory Huson
*Assistant Examiner* — Nicolas A Arnett
(74) *Attorney, Agent, or Firm* — Carrier Blackman & Associates, P.C.; William D. Blackman; Joseph P. Carrier

(57) ABSTRACT

A system for and method of refilling a liquid in a container. The system includes a one-way valve attachable to a liquid storage container. In a particular embodiment, the system is operable to refill a container for a liquid soap dispenser via the one-way valve and a hose connected to a refilling reservoir, through the operation of a pump. A method of refilling a liquid storage container using the inventive system is also described.

11 Claims, 9 Drawing Sheets

FIG. 2A
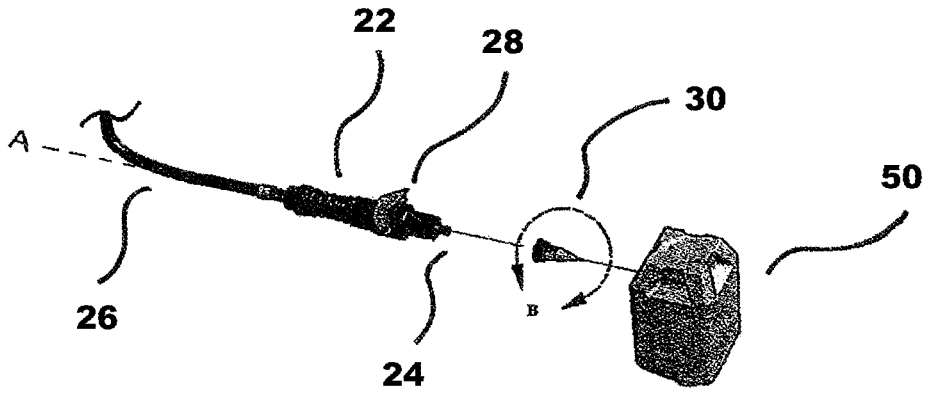
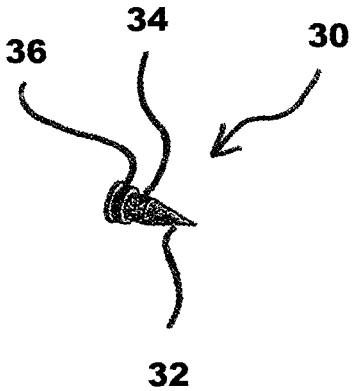
FIG. 2B

LIQUID CONTAINER REFILLING SYSTEM AND METHOD

BACKGROUND OF THE INVENTION

1. Field of the Invention

The present invention relates to a system for and method of refilling a liquid product in a storage container, which may be part of a point-of-use dispenser. More particularly, the present invention relates to a system and method including a nozzle assembly having a one-way valve therein, where the nozzle is attachable to a liquid storage container. In a particular embodiment, the system is operable to refill a container of liquid soap via the one-way valve, through the operation of a pump and a dispenser mechanism connected by a hose to a refilling reservoir.

2. Description of the Background Art

A number of different devices are known for dispensing liquids, in particular, liquid soaps. Examples of some of the known liquid-dispensing systems include U.S. Pat. No. 4,360,130 to Nishimura et al., U.S. Pat. No. 4,886,192 to Cassia, U.S. Pat. No. 5,480,068 to Frazier et al., U.S. Pat. No. 5,439,144 to Holzner, U.S. Pat. No. 5,992,698 to Copeland et al., and U.S. Pat. No. 7,654,417 to Rhodenburgh et al.

One type of known soap dispenser is adapted to receive a disposable cartridge containing the liquid soap. The cartridges on these types of dispensers are generally removable and replaceable; however, in practice, they are often replaced before the liquid product in the cartridge is completely empty. This may result in wasted product. Moreover, the cartridge also needs to be disposed, resulting in excess waste directed to landfills or incinerators. This system is time-consuming and not economical.

Another type of known soap dispenser includes a permanently fixed container or cartridge that can be refilled with additional liquid. A drawback of this design is that the container has a refill opening that could permit contamination of the contents. In addition, if the refillable cartridge is removable, the cartridges must be periodically cleaned and soap residue must be periodically removed to avoid clogging.

Attempts to solve the problems associated with removable and permanently fixed cartridges or containers that dispense liquids have not been entirely successful. Although the known devices have some utility for their intended purposes, there still exists a need for a system that can reduce waste associated with replacing liquid-containing cartridges in dispensers. There is also a need to use resources efficiently, in order to protect the environment and minimize landfill use.

SUMMARY OF THE INVENTION

It is an object of the present invention to provide a system that is operable to economically and efficiently refill a liquid container, while also minimizing waste. An apparatus according to the present invention is usable to refill liquid in a container through the use of an ergonomic handle in conjunction with a hose, pump and reservoir.

In one illustrative embodiment of the present invention, a check valve assembly, having an internal check valve therein, is inserted into, and extends through a side wall of a container to be refilled. A nozzle tip portion of a refilling dispenser device is then fitted into an inlet portion of the check valve assembly.

The check valve assembly forms a tight seal with the container, and remains permanently affixed to the container. Future refills of the container can be made with increased speed, using the permanently affixed check valve assembly.

The check valve assembly includes a sealing member for allowing liquids to enter the container but not leave the chamber. The check valve assembly aids in retaining the liquid product within the container. The refill handle of the dispenser mechanism may be equipped with a shut-off valve or switch that allows the user to control the flow of liquid from the reservoir into the container. The handle is also fitted with an outlet fitting that tightly fits into an inlet portion of the check valve assembly to prevent seepage of the liquid while refilling.

In one illustrative embodiment, the reservoir may be contained in a backpack-type storage unit that the user can easily wear to assist in refilling multiple containers in a plurality of locations. The backpack-type storage unit can also conveniently house a pumping mechanism to pump the liquid from the reservoir to the container. Optionally, the pump can be manually operated or driven by an electric motor.

In another illustrative embodiment intended for commercial or industrial applications, the reservoir may be situated on a rolling cart.

In a further illustrative embodiment, the handle is configured to allow for either filling of a container through the check valve assembly, or filling of a bag-type liquid container through a corresponding adapter.

The present invention also relates to a method of modifying an existing liquid container to include a check valve assembly, and filling the container.

When refilling a container that is not already adapted to be easily refillable, an initial step of piercing a container wall, using a pointed tip end of a check valve assembly, may be needed.

Then, the check valve assembly is installed into the wall of the container, in a slidable manner, until a portion of the container wall is received in the annular groove of the check valve assembly, so that the check valve assembly is fixedly sealed in place on the container.

The method may also include an optional step of removing the container to be filled from a supporting structure, such as a wall-mounted dispenser.

The method also includes a step of inserting the nozzle tip portion of a distribution mechanism into the container.

The method also includes a step of engaging an actuator of the distribution mechanism, to allow liquid to flow into the container.

The inventive method further includes a step of disengaging the actuator, once the container is full, to stop the flow of liquid.

The method may also include a further optional step of replacing the container on the supporting structure.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 2A is a detail perspective view of a dispenser mechanism of the apparatus of FIG. 1, shown with a check valve assembly and an exemplary liquid container.

FIG. 2B is a detail perspective view of the check valve assembly.

DETAILED DESCRIPTION OF ILLUSTRATIVE EMBODIMENTS

Descriptions will be provided below of selected illustrative embodiments of the present invention on a basis of examples of the present invention, supported by and shown in the accompanying drawings. It should be understood that only structures considered necessary for clarifying the present invention are described herein. Other conventional structures, and those of ancillary and auxiliary components of the system, will be known and understood by those skilled in the art.

Figure 1:
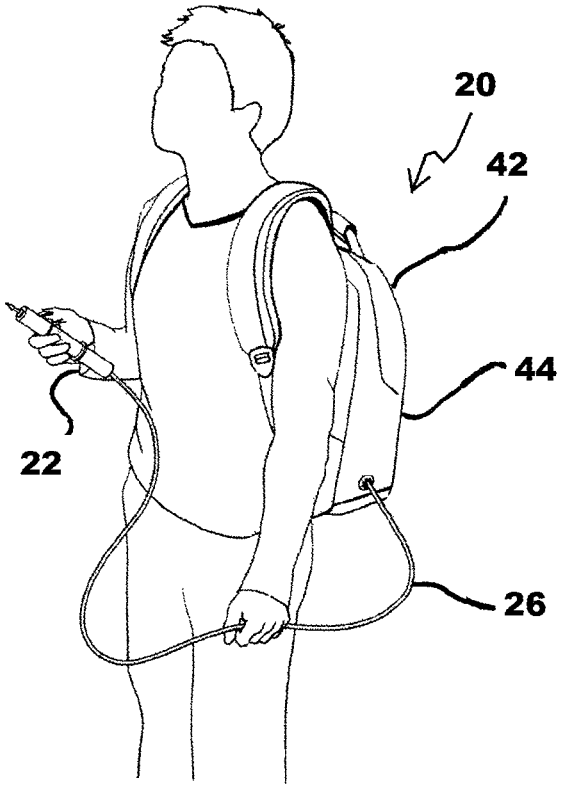
FIG. 1 is a perspective view of an apparatus for refilling liquids in a container, shown with an exemplary backpack-style reservoir, where the apparatus forms part of a system according to an illustrative embodiment of the invention.
Figure 2C:
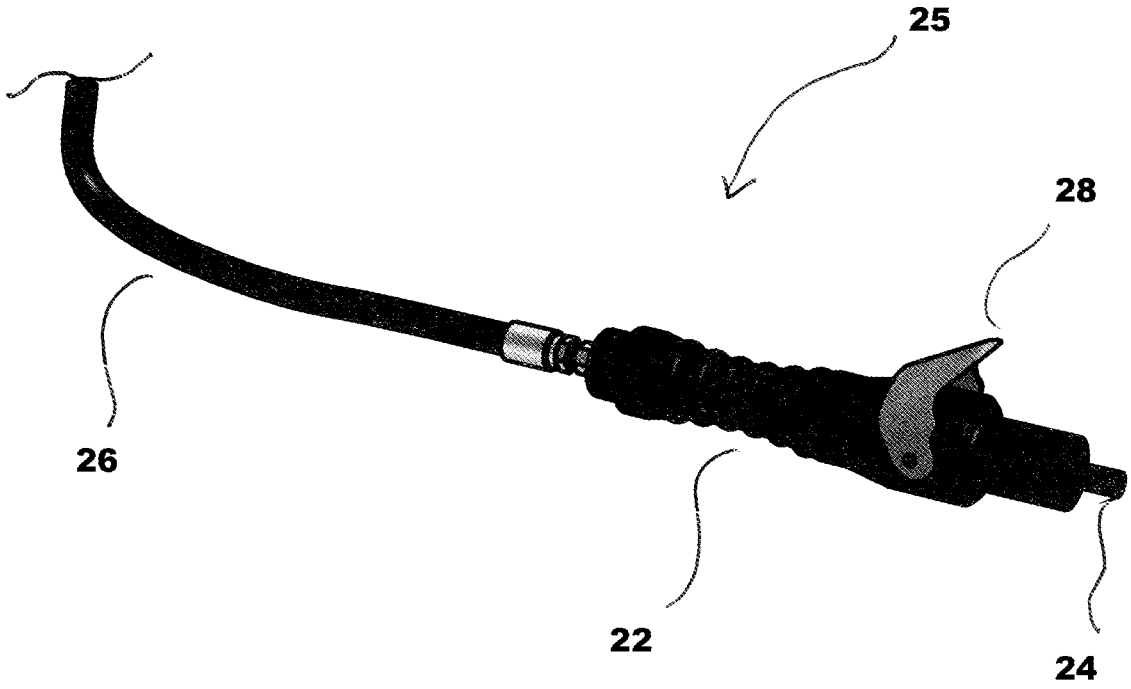
FIG. 2C is a detail perspective view of the dispenser mechanism of FIG. 2A.
Figure 3:
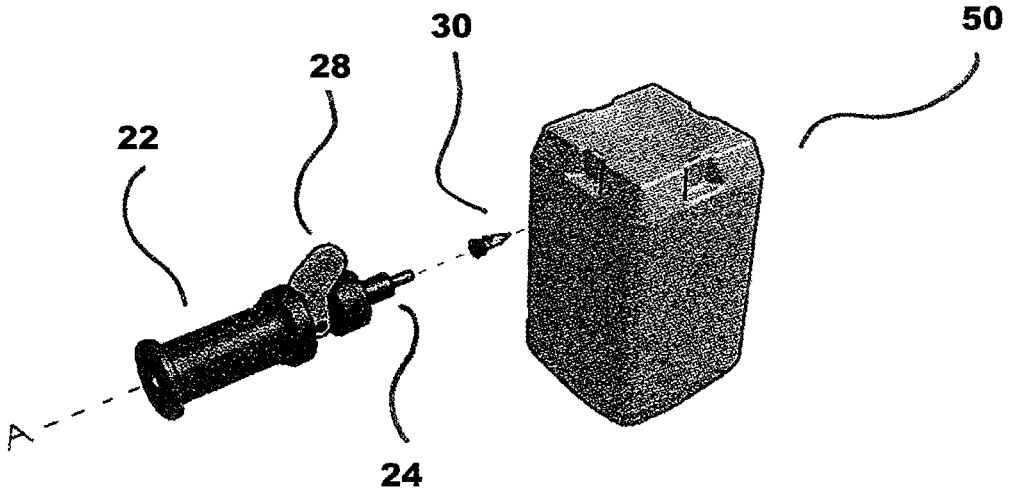
FIG. 3 is a further perspective view of a handle portion of the dispenser mechanism, shown with the check valve assembly and liquid container.

Referring now to FIGS. 1 and 2A-2C, a first illustrative embodiment of an apparatus for refilling liquid containers is shown generally at 20. In the embodiment of FIG. 1, the apparatus 20 includes a liquid reservoir 42 in fluid communication with a fluid delivery portion 25 including a hose 26 connected to a dispenser mechanism 22. The dispenser mechanism 22 includes an actuator 28 for controlling the flow of liquid through the hose. The dispenser mechanism 22 also includes an outlet nozzle fitting 24 for cooperative engagement with an inlet of a check valve assembly 30, as will be described subsequently. Liquid exits from the dispenser mechanism 22 via the outlet fitting 24.

Figure 4:
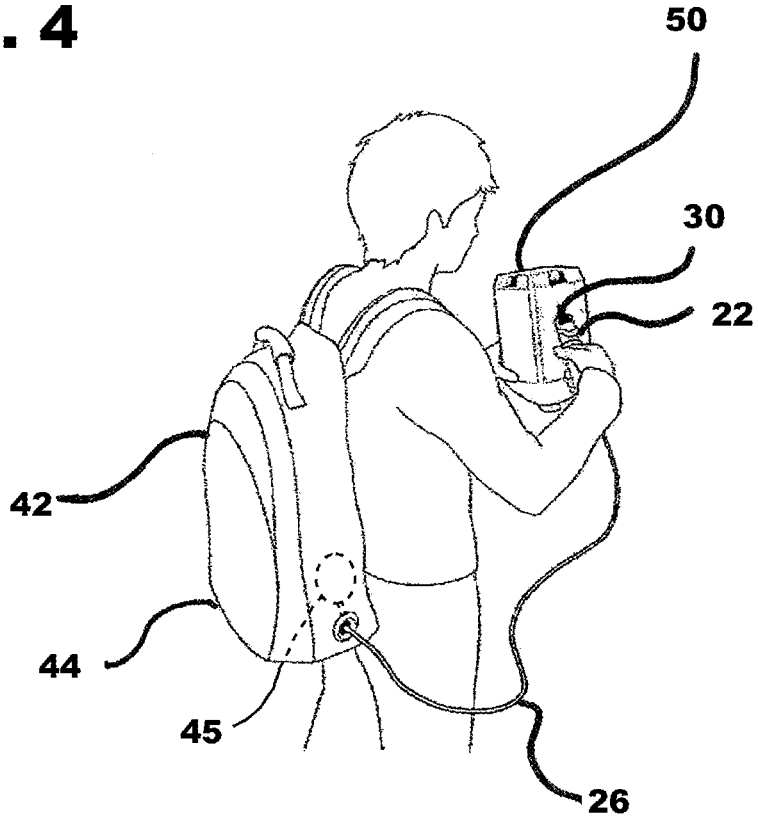
FIG. 4 is a perspective view of the apparatus of FIG. 1, shown in use refilling a box-shaped storage device.

Optionally, if desired, the actuator 28 may be connected to a manual pump apparatus disposed inside of the dispenser mechanism 22. Alternatively, the actuator 28 may simply contain a spring-loaded valve assembly and a switch, and a separate electric pump 45 (FIG. 4) may be provided inside of the reservoir, where such pump is in fluid communication with the hose 26.

Referring also to FIGS. 2B-2C and 3-5, the apparatus 20 includes the dispenser mechanism 22, the actuator 28, and the outlet fitting 24, as described. The outlet fitting 24 and dispenser mechanism 22 are located along an axial center line A, shown aligned with the check valve assembly 30 in FIG. 3. Further included in FIGS. 2A, and 3-5 is an exemplary liquid container 50. The liquid container 50 fits inside of a dispenser mechanism (not shown), and selectively dispenses the liquid from the container as requested by customers. Containers of this known type generally are made with either substantially rigid or semi-flexible plastic walls, which may be formed from polyethylene, polypropylene, polybutylene, polyethylene terepthalate (PET), or other suitable plastic materials known in the art.

Prior to installation of a check valve assembly 30 into a container 50, the check valve assembly is fitted on to the nozzle outlet fitting 24 of the dispenser mechanism 22 by an installer. The installer then pierces the wall 46 (FIG. 5) of the container 50 with the pointed tip of the check valve assembly 30, and presses the check valve assembly into the wall 46 of the liquid container 50 until an annular groove of the check valve assembly receives a portion of the wall therein. The check valve assembly 30 is placed into the wall 46 of the liquid container 50 at a portion thereof situated above the fluid level in the container. Then, the pump of the refill apparatus 20 is activated as needed to fill the container to a suitable fluid level.

Figure 5:
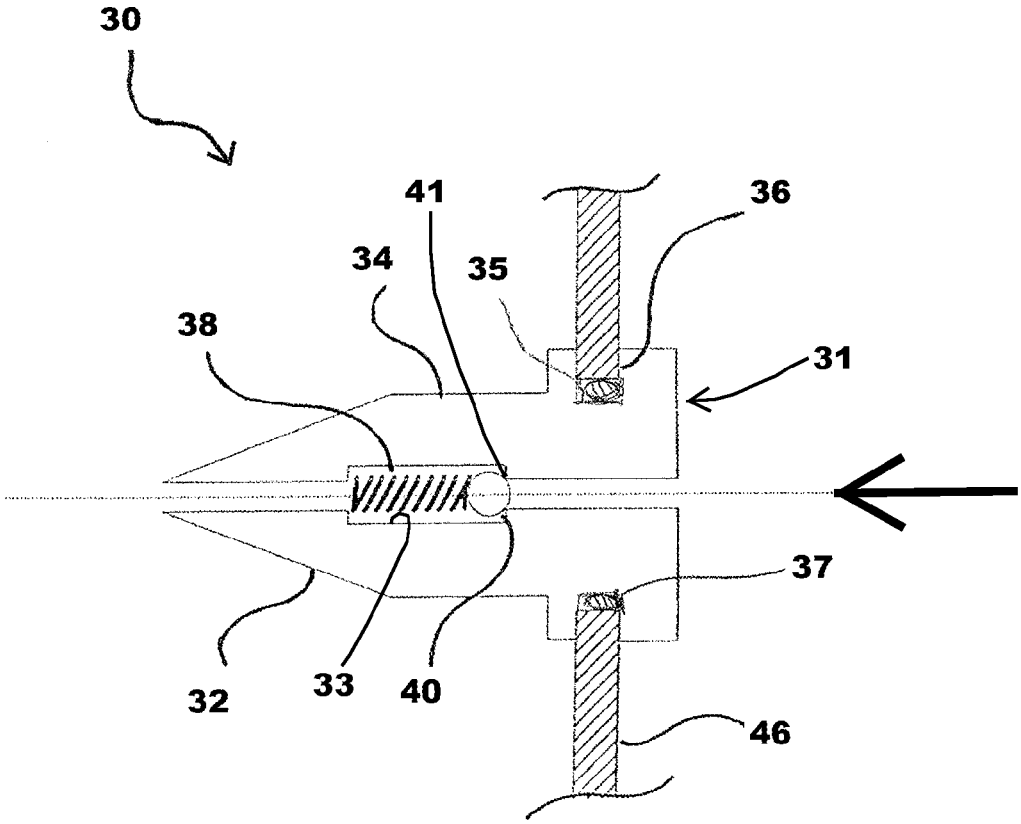
FIG. 5 is a cross-sectional view of the check valve assembly of FIG. 2B.

Referring now to FIG. 5, the check valve assembly 30 includes a hollow check valve body 31 having a spring chamber 33 formed therein for housing a check ball 40 and spring 38. The spring 38, during normal operation, maintains a compressive force against the check ball 40, forming a seal against a seat 41 formed at an inner wall of the check valve assembly 30. The seal not only prevents liquid from exiting the liquid container 50 through the check valve assembly 30, but also prevents contamination from entering the liquid container 50. When the liquid refill operation is undertaken, the liquid entering the check valve assembly 30 applies a force against the check ball 40 to move it away from the inner wall, compressing the spring 38 and allowing the liquid to pass inwardly through the check valve assembly 30 and into the liquid container 50. (While one design for the shape of the check valve body is shown, it will be understood that the external shape of the check valve body may be modified, if desired, to make it easier for the check valve assembly to be slidably installed into a wall 46 of a container 50.

After the container has been filled to capacity, the outlet fitting 24 is removed from the check valve assembly 30, which remains permanently engaged with the liquid container 50, providing a one-way valve which will allow liquid to enter the container during a refill operation, but which does not allow liquid to pass outwardly therethrough to exit the liquid container 50. Leaving the check valve assembly 30 engaged with the container 50 in this way enables a user to refill the same container multiple times as needed via the check valve, thereby facilitating re-use of the container, reducing refill costs, conserving resources, and reducing waste which would otherwise occur if the container were to be replaced each time the contents run low.

As shown in FIGS. 2B and 5, the check valve assembly 30 includes a piercing tip portion 32, an elongated portion 34, and a sealing portion 36. The sealing portion 36 has an annular groove 35 formed therein which receives and contacts an adjacent portion of the wall of the liquid container 50, and forms a fluid-tight seal, thus not allowing any liquid to flow outwardly past the seal. The check valve assembly 30 may further include a sealing member such as, for example, an O-ring seal 37 disposed in the annular groove 35.

Referring once again to FIG. 1, the illustrative embodiment is shown generally with the dispenser mechanism 22 connected to the hose 26, which is fluidly connected to a reservoir 42, which may optionally be enclosed in a backpack-style storage and dispensing device 44. The reservoir 42 can additionally be provided with a suitable pump 45 usable to transfer the liquid from the reservoir 42 to the liquid container 50. Optionally, the pump may be manually or electronically driven.

In the embodiment of FIGS. 1-5, the dispenser mechanism 22 can be used together with the hose 26, reservoir 42 and check valve assembly 30 to refill a liquid container 50 having either flexible, semi-flexible or substantially rigid side walls, such as the side wall shown at 46.

Figure 6:
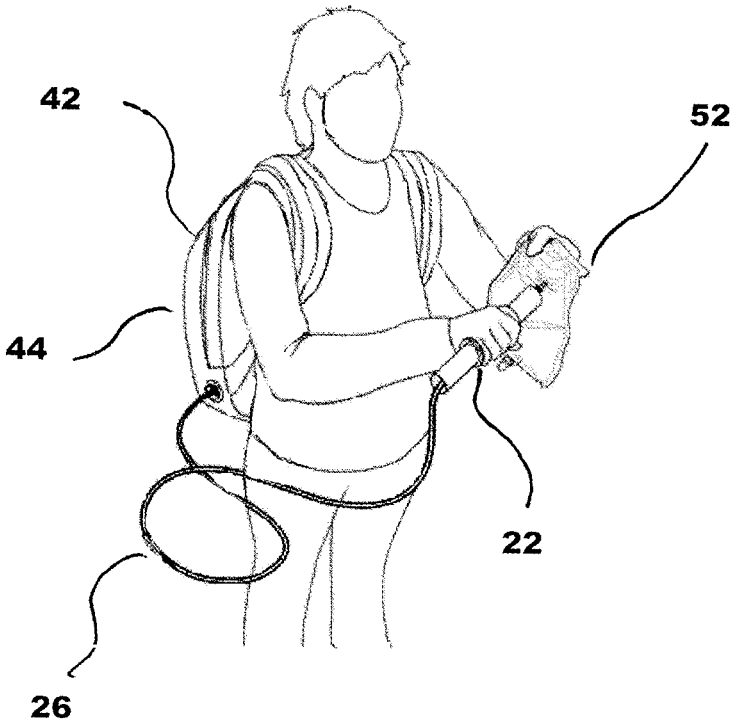
FIG. 6 is another perspective view of the apparatus of FIG. 1, shown in use refilling a bag portion of a storage device.

Alternatively, in the embodiment of FIG. 6, the dispenser mechanism 22 can be used to fill flexible bag-type liquid containers 52 through an integrally manufactured check valve on the bag, without requiring the check valve assembly 30 to pierce the bag.

Figure 7:
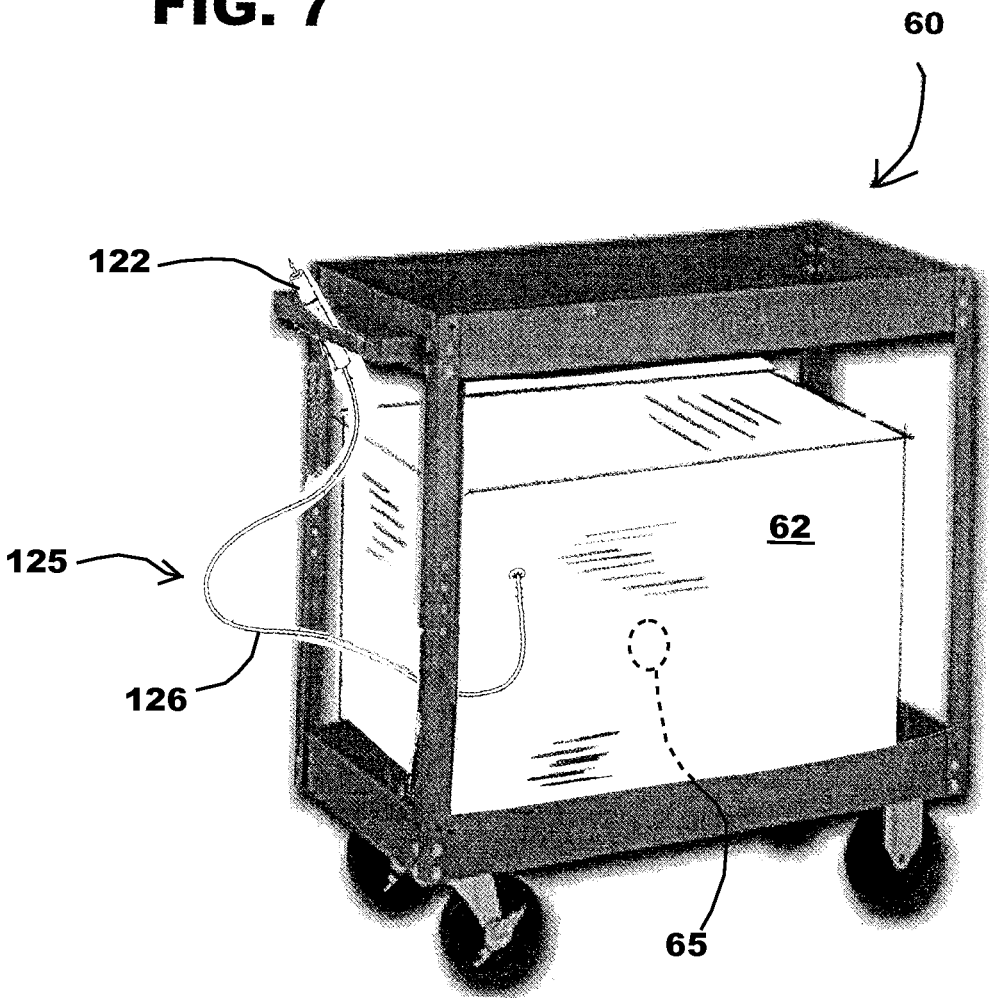
FIG. 7 is a perspective view of a rolling cart which is optionally usable to support a larger refill reservoir according to an alternative embodiment of the present invention.

In another alternative, as shown in FIG. 7, a rolling cart 60 could be used to provide a reservoir and dispenser apparatus, in an industrial or commercial application, as an alternative to the backpack storage and dispensing device 44 shown in FIGS. 1-5 of the drawings, where a suitable reservoir tank 62 could be situated on the cart 60. This embodiment also includes a delivery mechanism 125 including a hose 126 and dispenser mechanism 122, similar to the dispenser mechanism 22 shown in FIG. 2C, extending from the reservoir tank 62. In addition, this embodiment has an electric pump 65 disposed inside of the reservoir tank 60, and an outlet of this pump is in fluid communication with the delivery mechanism 125. The apparatus of FIG. 7 would be used in a manner similar to that described above in connection with the backpack storage and dispensing device 44.

Method

Figure 8:
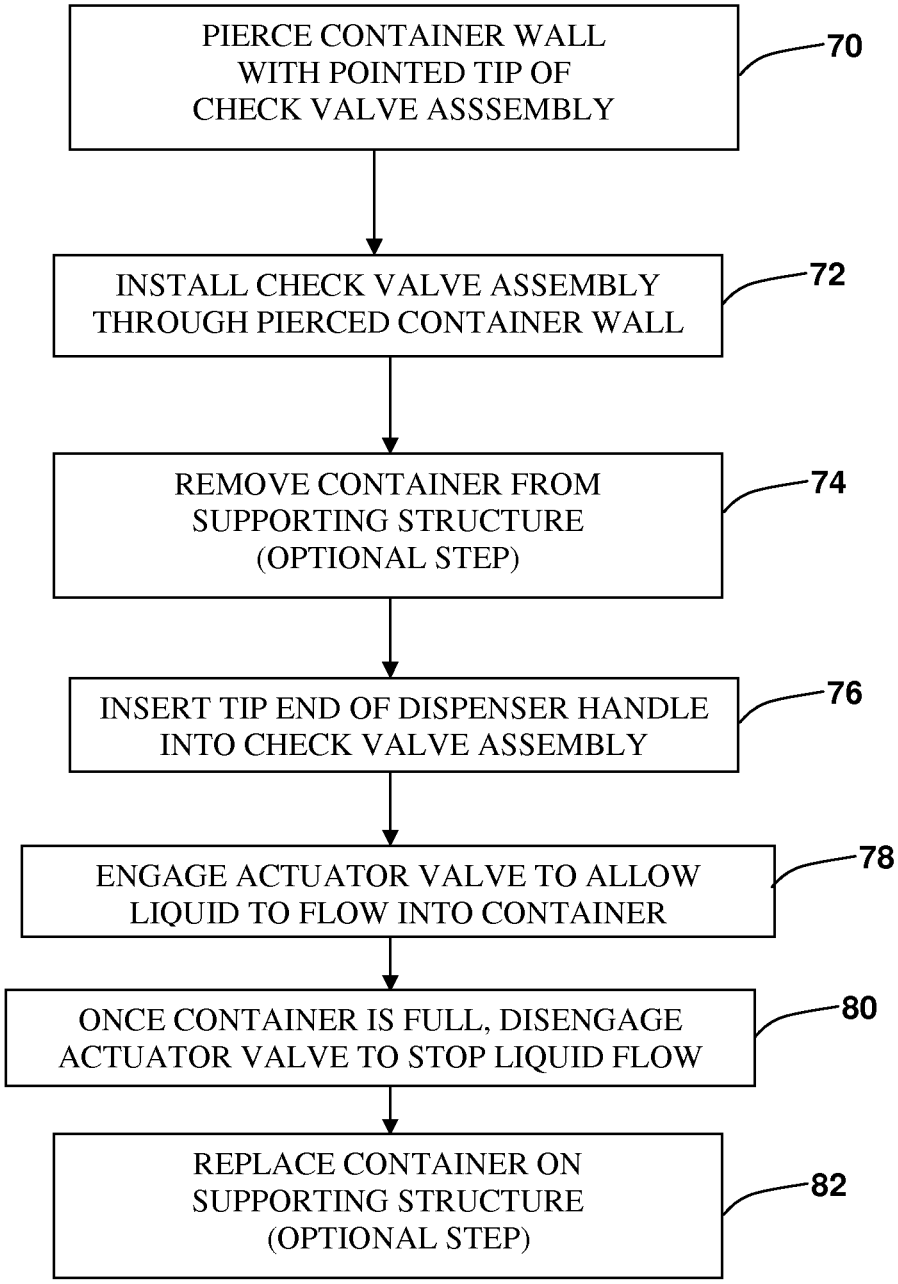
FIG. 8 is a chart demonstrating outlined steps for practicing operation of a method according to another illustrative embodiment of the invention.

Referring now to FIG. 8, a series of steps for practicing a method according to another illustrative embodiment of the present invention are outlined. It will be understood that the sequence of the following steps may be varied without departing from the scope of the invention.

When refilling a container that is not already adapted to be easily refillable, an initial step of piercing the container wall 46 using a pointed tip end 32 of a check valve assembly 30 is shown at 70 in FIG. 8.

Then, the check valve assembly 30 is installed into the wall 46 of the container 50 in a slidable manner until a portion of the container wall 46 is received in the annular groove 35 of the check valve assembly, so that the check valve assembly 30 is fixedly sealed on to the container, as shown at step 72 in FIG. 8.

The method may also include an optional step of removing the container to be filled from a supporting structure, such as a wall-mounted dispenser. This optional step is shown at 74 in FIG. 8.

The method also includes a step of inserting the nozzle tip portion 24 of the distribution mechanism 25 into the container. This step is shown at 76 in FIG. 8.

The method also includes a step of engaging the actuator 28 of the distribution mechanism 22, to allow liquid to flow into the container. This step is shown at 78 in FIG. 8.

The inventive method further includes a step of disengaging the actuator 28, once the container is full, to stop the flow of liquid. This step is shown at 80 in FIG. 8.

The method may also include a further optional step of replacing the container on the supporting structure. This step is shown at 82 in FIG. 8.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

Having thus described the invention, what is claimed is:

1. A system for refilling a liquid container, said system comprising:

a reservoir;

a pump for transferring liquid from said reservoir;

a flexible hose extending from the reservoir;

a dispenser attached to and communicating with the hose, the dispenser having an actuator thereon and comprising an outlet nozzle configured to engage with a check valve assembly;

a check valve assembly which is slidably engagable with the dispenser via the outlet nozzle, the check valve assembly formed as a separate member from the dispenser and configured to be attached to a wall of said container and left in place thereon to provide access thereto for refilling;

wherein the check valve assembly comprises a hollow housing having a pointed tip end configured to pierce through the wall of said container, the housing having a sidewall with an annular groove formed therein.

2. The system for refilling a liquid container according to claim 1, wherein the housing has an internal spring chamber formed therein, and wherein the check valve assembly comprises a spring disposed in the spring chamber and engaged with a check ball.

3. The system for refilling a liquid container according to claim 1, wherein the pump is in fluid communication with the reservoir and hose.

4. The system for refilling a liquid container according to claim 3, wherein the pump is manually operated.

5. The system for refilling a liquid container according to claim 3, wherein the actuator comprises a switch, and the pump is electrically driven.

6. A system for refilling a liquid container, said system comprising:

a reservoir;

a pump for transferring liquid from said reservoir;

a flexible hose extending from the reservoir and communicating with said pump;

a dispenser attached to and communicating with the hose, the dispenser having an actuator thereon and comprising an outlet nozzle configured to engage with a check valve assembly;

a check valve assembly which is slidably engagable with the dispenser via the outlet nozzle, the check valve assembly formed as a separate member from the dispenser and configured to be attached to a wall of said container and left in place thereon to provide access thereto for refilling;

wherein the check valve assembly comprises housing comprising a pointed tip end configured to pierce through the wall of said container, the housing having a sidewall with an annular groove thereon, the housing having an internal spring chamber formed therein, and wherein the check valve assembly comprises a spring disposed in the spring chamber and engaged with a check ball.

7. The system for refilling a liquid container according to claim 6, wherein the pump is manually operated.

8. The system for refilling a liquid container according to claim 6, wherein the actuator comprises a switch, and the pump is electrically driven.

9. The system for refilling a liquid container according to claim 6, wherein the check valve assembly has a sealing member disposed in said annular groove of said sidewall.

10. A method of refilling a liquid in a container, the method comprising the steps of:

a) piercing a wall of a container with a pointed tip end of a check valve assembly which comprises a hollow housing having a sidewall with an annular groove formed therein;

b) pressing the check valve assembly into the wall of the container, and affixing the check valve assembly to the wall of the containers, the check valve assembly configured to be attached to a wall of said container and left in place thereon to provide access thereto for refilling;

c) optionally, removing the container from a supporting structure;

d) inserting a nozzle outlet portion of a handle into an inlet of the check valve;

e) engaging an activator to cause liquid to flow from a reservoir, through a hose, and through the check valve assembly into the container;

f) disengaging the activator when the container is full of liquid to stop the flow of liquid into the container;

g) removing the handle from the check valve assembly while leaving the check valve in lace on the container to provide access thereto for refilling; and h) optionally, replacing the container on the supporting structure.

11. The method according to claim 10, wherein the housing has an internal spring chamber formed therein, and wherein the check valve assembly comprises a spring disposed in the spring chamber and engaged with a check ball.

* * * * *